US011557416B2

(12) United States Patent
Hirukawa

(10) Patent No.: US 11,557,416 B2
(45) Date of Patent: Jan. 17, 2023

(54) MULTILAYER COIL COMPONENT

(71) Applicant: Murata Manufacturing Co., Ltd., Kyoto-fu (JP)

(72) Inventor: Atsuo Hirukawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 369 days.

(21) Appl. No.: 16/881,178

(22) Filed: May 22, 2020

(65) Prior Publication Data

US 2020/0373065 A1 Nov. 26, 2020

(30) Foreign Application Priority Data

May 24, 2019 (JP) ..... JP2019-097638

(51) Int. Cl.
*H01F 17/00* (2006.01)
*H01F 27/29* (2006.01)
(Continued)

(52) U.S. Cl.
CPC ..... *H01F 17/0013* (2013.01); *H01F 27/29* (2013.01); *H01F 27/324* (2013.01); *H01F 41/041* (2013.01); *H01F 41/12* (2013.01)

(58) Field of Classification Search
CPC ..... H01F 17/0013; H01F 27/29; H01F 27/324
See application file for complete search history.

(56) References Cited

U.S. PATENT DOCUMENTS 6,147,573 A * 11/2000 Kumagai ..... H03H 7/0115 336/200
6,154,114 A * 11/2000 Takahashi ..... H01F 17/0013 336/200
(Continued)

FOREIGN PATENT DOCUMENTS

JP 09129447 A * 5/1997
JP H09-129447 A 5/1997
JP 2002198229 A * 7/2002
JP 2002270428 A * 9/2002
(Continued)

OTHER PUBLICATIONS

An Office Action; "Notice of Reasons for Refusal," mailed by the Japanese Patent Office dated Nov. 30, 2021, which corresponds to Japanese Patent Application No. 2019-097638 and is related to U.S. Appl. No. 16/881,178 with English translation.

*Primary Examiner* — Elvin G Enad
*Assistant Examiner* — Malcolm Barnes
(74) *Attorney, Agent, or Firm* — Studebaker & Brackett PC

(57) ABSTRACT

A multilayer coil component includes a multilayer body, and first and second outer electrodes. The multilayer body is formed by stacking plural insulating layers in a length direction, and includes a coil incorporated therein. The first and second outer electrodes are electrically connected to the coil. The coil is formed by electrically connecting plural coil conductors stacked in the length direction together with the insulating layers. The multilayer body has first and second end surfaces, first and second major surfaces, and first and second lateral surfaces. The first outer electrode has first, second, and third electrode portions. As viewed in plan in the width direction, the third electrode portion is substantially concave toward a vertex where first and second edges meet, the first edge being an edge where the first and third electrode portions meet, the second edge being an edge where the second and third electrode portions meet.

20 Claims, 7 Drawing Sheets

(51) Int. Cl.

| | |
|---|---|
| ***H01F 27/32*** | (2006.01) |
| ***H01F 41/04*** | (2006.01) |
| ***H01F 41/12*** | (2006.01) |

(56) References Cited

U.S. PATENT DOCUMENTS

| | | | | |
|---|---|---|---|---|
| 2005/0013083 | A1* | 1/2005 | Takazawa | H01F 17/0013 361/118 |
| 2005/0018382 | A1* | 1/2005 | Takazawa | H01F 17/0013 361/321.2 |
| 2005/0052267 | A1* | 3/2005 | Singu | H01F 27/292 336/83 |
| 2013/0214888 | A1* | 8/2013 | Nogi | H01F 27/29 336/192 |
| 2014/0145815 | A1* | 5/2014 | Ishii | H01F 17/0013 336/200 |
| 2014/0145816 | A1* | 5/2014 | Sato | H01F 17/0013 336/208 |
| 2017/0018351 | A1* | 1/2017 | Yatabe | H01F 27/2804 |
| 2017/0256352 | A1* | 9/2017 | Kido | H01F 27/2804 |
| 2017/0352467 | A1* | 12/2017 | Kakiuchi | H01F 27/29 |
| 2018/0057408 | A1* | 3/2018 | Kakuda | H01F 41/0246 |
| 2018/0068780 | A1* | 3/2018 | Shimoda | H01F 17/0013 |
| 2018/0166206 | A1 | 6/2018 | Ueyama et al. | |
| 2019/0122808 | A1* | 4/2019 | Jo | H01F 17/02 |
| 2021/0125783 | A1* | 4/2021 | Onodera | H01G 2/06 |

FOREIGN PATENT DOCUMENTS

| | | | |
|---|---|---|---|
| JP | 2014-107513 | A | 6/2014 |
| JP | 2018-098368 | A | 6/2018 |

* cited by examiner

MULTILAYER COIL COMPONENT

CROSS-REFERENCE TO RELATED APPLICATION

This application claims benefit of priority to Japanese Patent Application No. 2019-097638, filed May 24, 2019, the entire content of which is incorporated herein by reference.

BACKGROUND

Technical Field

The present disclosure relates to a multilayer coil component.

Background Art

For example, Japanese Unexamined Patent Application Publication No. 9-129447 discloses a multilayer coil component in which the axial direction of a coil formed by electrically connecting coil conductors is parallel to the mounting surface of the multilayer coil component, and the stacking direction of a multilayer body including the coil conductors and insulating members is parallel to the mounting surface.

The multilayer inductor described in Japanese Unexamined Patent Application Publication No. 9-129447 includes an outer electrode disposed on each end portion of the multilayer body. This configuration is designed to reduce the stray capacitance between the coil and the outer electrode. With the configuration of the multilayer inductor described in Japanese Unexamined Patent Application Publication No. 9-129447, however, the absence of any outer electrode on the mounting surface presumably leads to insufficient mountability. Even if the outer electrode is disposed on the mounting surface in an attempt to improve mountability, simply disposing the outer electrode on the mounting surface can cause the stray capacitance between the coil and the outer electrode to increase, resulting in degradation of radio frequency characteristics in the radio frequency range.

SUMMARY

Accordingly, the present disclosure provides a multilayer coil component that allows for both improved mountability and improved radio frequency characteristics.

A multilayer coil component according to preferred embodiments of the present disclosure includes a multilayer body, and a first outer electrode and a second outer electrode. The multilayer body is formed by stacking plural insulating layers in a length direction, and includes a coil incorporated in the multilayer body. The first outer electrode and the second outer electrode are electrically connected to the coil. The coil is formed by electrically connecting plural coil conductors that are stacked in the length direction together with the insulating layers. The multilayer body has a first end surface and a second end surface that face each other in the length direction, a first major surface and a second major surface that face each other in a height direction orthogonal to the length direction, and a first lateral surface and a second lateral surface that face each other in a width direction orthogonal to the length direction and to the height direction. The first major surface is a mounting surface. The stacking direction of the multilayer body, and the direction of the coil axis of the coil are parallel to the first major surface. The first outer electrode has a first electrode portion that covers a portion of the first end surface, a second electrode portion that extends from the first electrode portion to cover a portion of the first major surface, and a third electrode portion that extends from the first electrode portion and the second electrode portion to cover a portion of the first lateral surface. As viewed in plan in the width direction, the third electrode portion is substantially concave toward a vertex where a first edge and a second edge meet, the first edge being an edge where the first electrode portion and the third electrode portion meet, the second edge being an edge where the second electrode portion and the third electrode portion meet.

Other features, elements, characteristics and advantages of the present disclosure will become more apparent from the following detailed description of preferred embodiments of the present disclosure with reference to the attached drawings.

DETAILED DESCRIPTION

A multilayer coil component according to the present disclosure will be described below. The present disclosure is not limited to the configurations described below but may be modified as appropriate without departing from the scope of the present disclosure. The present disclosure also encompasses combinations of individual preferred features described hereinbelow.

Multilayer Coil Component

Figure 1:
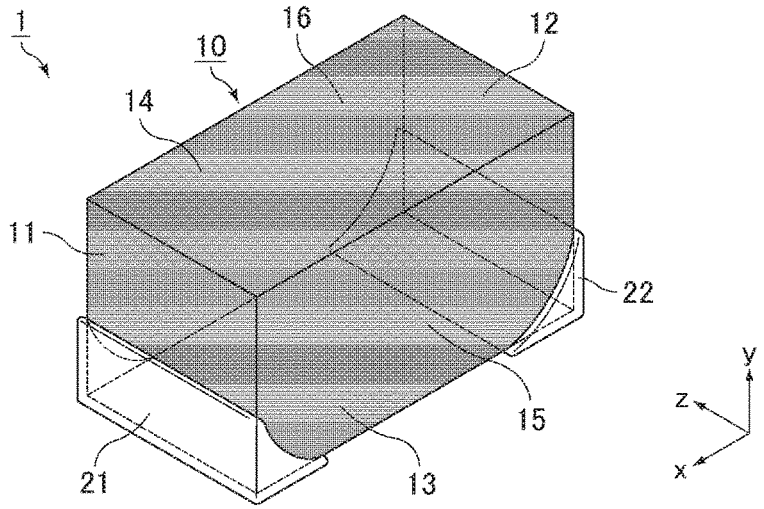
FIG. 1 is a schematic perspective view of an exemplary multilayer coil component according to the present disclosure.

FIG. 1 is a schematic perspective view of an exemplary multilayer coil component according to the present disclosure. As illustrated in FIG. 1, a multilayer coil component 1 includes a multilayer body 10, a first outer electrode 21, and a second outer electrode 22. Although the configuration of the multilayer body 10 will be described later in more detail, the multilayer body 10 is formed by stacking plural insulating layers, and includes a coil incorporated in the multilayer body 10. The first outer electrode 21 and the second outer electrode 22 are each electrically connected to the coil.

For the multilayer coil component 1 and the multilayer body 10, the length direction, the height direction, and the width direction are respectively defined as x-direction, y-direction, and z-direction in FIG. 1. The length direction (x-direction), the height direction (y-direction), and the width direction (z-direction) are orthogonal to each other.

The multilayer body 10 has a substantially cuboid shape with six faces. The multilayer body 10 has a first end surface 11 and a second end surface 12 that face each other in the length direction, a first major surface 13 and a second major surface 14 that face each other in the height direction orthogonal to the length direction, and a first lateral surface 15 and a second lateral surface 16 that face each other in the width direction orthogonal to the length and height directions. The first major surface 13 serves as the mounting surface in mounting the multilayer coil component 1 onto a substrate.

The corners and edges of the multilayer body 10 are preferably rounded. A corner of the multilayer body 10 refers to where three faces of the multilayer body 10 meet. An edge of the multilayer body 10 refers to where two faces of the multilayer body 10 meet.

Figure 2:
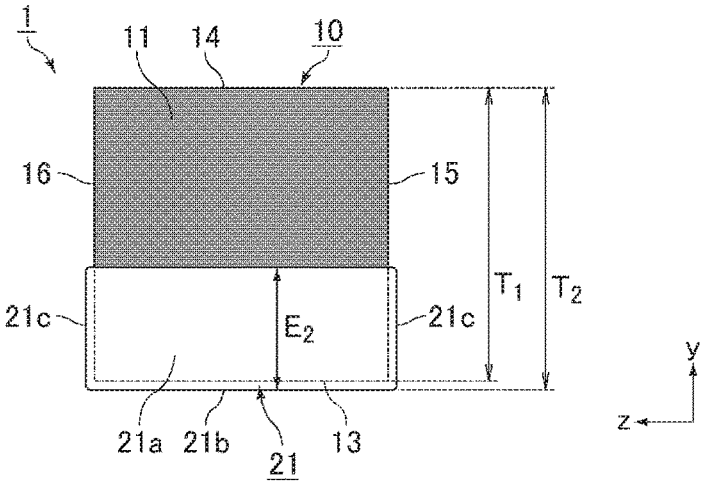
FIG. 2 is a schematic plan view of the multilayer coil component illustrated in FIG. 1 as seen from a first end surface.
Figure 3:
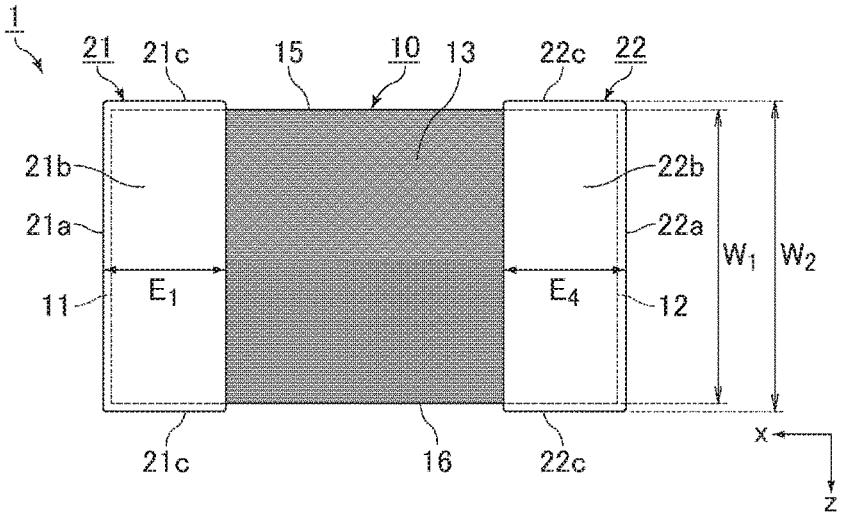
FIG. 3 is a schematic plan view of the multilayer coil component illustrated in FIG. 1 as seen from a first major surface.
Figure 4:
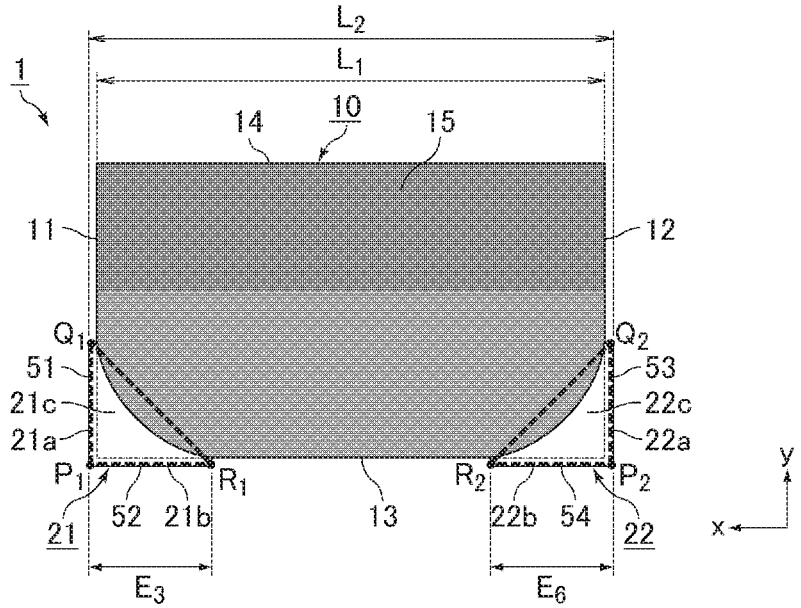
FIG. 4 is a schematic plan view of the multilayer coil component illustrated in FIG. 1 as seen from a first lateral surface.
Figure 5:
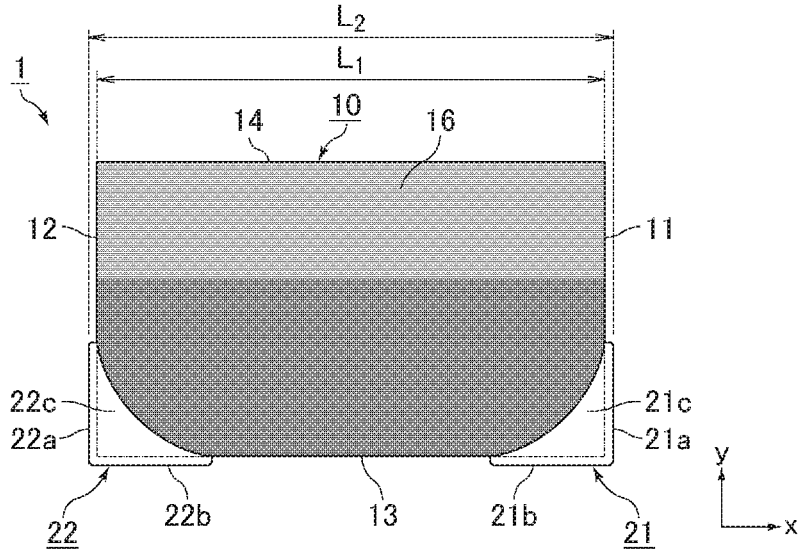
FIG. 5 is a schematic plan view of the multilayer coil component illustrated in FIG. 1 as seen from a second lateral surface.
Figure 6:
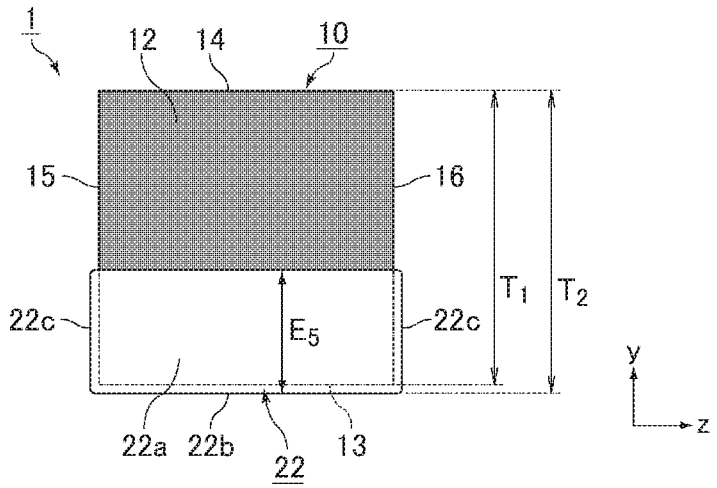
FIG. 6 is a schematic plan view of the multilayer coil component illustrated in FIG. 1 as seen from a second end surface.

FIG. 2 is a schematic plan view of the multilayer coil component illustrated in FIG. 1 as seen from the first end surface. FIG. 3 is a schematic plan view of the multilayer coil component illustrated in FIG. 1 as seen from the first major surface. FIG. 4 is a schematic plan view of the multilayer coil component illustrated in FIG. 1 as seen from the first lateral surface. FIG. 5 is a schematic plan view of the multilayer coil component illustrated in FIG. 1 as seen from the second lateral surface. FIG. 6 is a schematic plan view of the multilayer coil component illustrated in FIG. 1 as seen from the second end surface.

As illustrated in FIGS. 2, 3, and 4, the first outer electrode 21 has a first electrode portion 21*a*, a second electrode portion 21*b*, and a third electrode portion 21*c*.

As illustrated in FIG. 2, the first electrode portion 21*a* covers a portion of the first end surface 11. More specifically, the first electrode portion 21*a* covers a region of the first end surface 11 including the edge that meets the first major surface 13, and does not cover a region of the first end surface 11 including the edge that meets the second major surface 14. The first end surface 11 is thus exposed in the region including the edge that meets the second major surface 14.

Although the first electrode portion 21*a* has a height dimension (dimension in the height direction) $E_2$ that is constant in FIG. 2, the height dimension $E_2$ may not be constant. For example, as viewed in plan in the length direction, the first electrode portion 21*a* may have a substantially chevron shape with the height dimension $E_2$ that increases from its each widthwise end portion toward the central portion.

As illustrated in FIG. 3, the second electrode portion 21*b* extends from the first electrode portion 21*a* to cover a portion of the first major surface 13. More specifically, the second electrode portion 21*b* covers a region of the first major surface 13 including the edge that meets the first end surface 11, and does not cover a region of the first major surface 13 including the edge that meets the second end surface 12.

Although the second electrode portion 21*b* has a length dimension (dimension in the length direction) $E_1$ that is constant in FIG. 3, the length dimension $E_1$ may not be constant. For example, as viewed in plan in the height direction, the second electrode portion 21*b* may have a substantially chevron shape with the length dimension $E_1$ that increases from its each widthwise end portion toward the central portion.

As illustrated in FIG. 4, the third electrode portion 21*c* extends from the first electrode portion 21*a* and the second electrode portion 21*b* to cover a portion of the first lateral surface 15. More specifically, the third electrode portion 21*c* covers a region of the first lateral surface 15 including the vertex that meets the first end surface 11 and the first major surface 13, and does not cover a region of the first lateral surface 15 including the vertex that meets the first end surface 11 and the second major surface 14.

As described above, the first outer electrode 21 is disposed so as to cover not only a portion of the first major surface 13 serving as the mounting surface, but also a portion of the first lateral surface 15. This configuration improves the mountability of the multilayer coil component 1. It is to be noted that the first outer electrode 21 does not cover the second major surface 14.

As viewed in plan in the width direction, the third electrode portion 21*c* is substantially concave toward a vertex $P_1$ where a first edge 51 and a second edge 52 meet, the first edge 51 being the edge where the first electrode portion 21*a* and the third electrode portion 21*c* meet, the second edge 52 being the edge where the second electrode portion 21*b* and the third electrode portion 21*c* meet. Consequently, for the first outer electrode 21, the area of the third electrode portion 21*c* that covers a portion of the first lateral surface 15 decreases. This results in reduced stray capacitance between the coil incorporated in the multilayer body 10, and the first outer electrode 21 (third electrode portion 21*c*), leading to improved radio frequency characteristics of the multilayer coil component 1.

Therefore, the multilayer coil component 1 allows for both improved mountability and improved radio frequency characteristics. As for the radio frequency characteristics of the multilayer coil component 1 in the radio frequency range (in particular, from about 30 GHz or above to about 80 GHz or below (i.e., from about 30 GHz to about 80 GHz)), the transmission coefficient S21 at about 40 GHz is preferably not less than about −1 dB and not more than about 0 dB (i.e., from about −1 dB to about 0 dB), and the transmission coefficient S21 at about 50 GHz is preferably not less than about −2 dB and not more than about 0 dB (i.e., from about −2 dB to about 0 dB). If the multilayer coil component 1 satisfies the above-mentioned condition, the multilayer coil component 1 can be suitably employed for, for example, a bias-tee circuit within an optical communication circuit. The transmission coefficient S21 is calculated as the ratio of the power of a transmitted signal to the power of an input signal. The transmission coefficient S21 at each individual frequency is determined by using, for example, a network analyzer. Although the transmission coefficient S21 is basically a dimensionless quantity, the transmission coefficient S21 is normally represented in units of dB by taking its common logarithm.

As viewed in plan in the width direction, the first outer electrode 21 has an area of preferably not less than about 20% and not more than about 80% (i.e., from about 20% to about 80%) of the area of a triangle $P_1Q_1R_1$, which is defined as a triangle formed by connecting the vertex $P_1$, a first endpoint $Q_1$, and a second endpoint $R_1$ in the third electrode portion 21*c* with each other by straight lines (dashed lines in FIG. 4), the first endpoint $Q_1$ being an endpoint lying on the first edge 51 and different from the vertex $P_1$, the second endpoint $R_1$ being an endpoint lying on the second edge 52 and different from the vertex $P_1$. If the third electrode portion 21*c* has an area of less than about 20% of the area of the triangle $P_1Q_1R_1$, this results in reduced area of the third electrode portion 21*c* involved in mounting the multilayer coil component 1, which may make it difficult to improve the mountability of the multilayer coil component 1. If the third electrode portion 21*c* has an area of more than about 80% of the area of the triangle $P_1Q_1R_1$, this results in increased stray capacitance between the coil incorporated in the multilayer body 10, and the first outer electrode 21 (third electrode portion 21*c*), which may cause degradation of the radio frequency characteristics of the multilayer coil component 1.

When it is herein stated that the third electrode portion 21*c* is substantially concave toward the vertex $P_1$ as viewed in plan in the width direction, this means that the contour connecting the first endpoint $Q_1$ and the second endpoint $R_1$ in the third electrode portion 21*c* is located closer to the vertex $P_1$ than the straight line (dashed line in FIG. 4) connecting the first endpoint $Q_1$ and the second endpoint $R_1$, except at the first endpoint $Q_1$ and the second endpoint $R_1$.

As viewed in plan in the width direction, the contour connecting the first endpoint $Q_1$ and the second endpoint $R_1$ in the third electrode portion 21*c* preferably has a substantially arcuate shape as illustrated in FIG. 4.

As viewed in plan in the width direction, the third electrode portion 21*c* has a dimension $E_3$ on the second edge 52 of preferably not less than about 40 μm and not more than about 145 μm (i.e., from about 40 μm to about 145 μm). If the dimension $E_3$ on the second edge 52 of the third electrode portion 21*c* is less than about 40 μm, this results in reduced area of the third electrode portion 21*c* involved in mounting the multilayer coil component 1, which may make it difficult to improve the mountability of the multilayer coil component 1. If the dimension $E_3$ on the second edge 52 of the third electrode portion 21*c* is more than about 145 μm, this results in increased stray capacitance between the coil incorporated in the multilayer body 10, and the first outer electrode 21 (third electrode portion 21*c*), which may cause degradation of the radio frequency characteristics of the multilayer coil component 1. It is to be noted that FIGS. 3 and 4 illustrate an exemplary state in which the dimension $E_3$ on the second edge 52 of the third electrode portion 21*c* is equal to the length dimension $E_1$ of the second electrode portion 21*b*.

As illustrated in FIG. 5, the third electrode portion 21*c* may extend from the first electrode portion 21*a* and the second electrode portion 21*b* to cover a portion of the second lateral surface 16. More specifically, the third electrode portion 21*c* may cover a region of the second lateral surface 16 including the vertex that meets the first end surface 11 and the first major surface 13, and may not cover a region of the second lateral surface 16 including the vertex that meets the first end surface 11 and the second major surface 14.

As viewed in plan in the width direction, the third electrode portion 21*c* that covers a portion of the second lateral surface 16 may be similar in shape (substantially concave shape) to the third electrode portion 21*c* that covers a portion of the first lateral surface 15. In this case, the first outer electrode 21 is disposed so as to cover not only a portion of the first major surface 13, which serves as the mounting surface, and a portion of the first lateral surface 15, but also a portion of the second lateral surface 16. This configuration further improves the mountability of the multilayer coil component 1. Further, for the first outer electrode 21, as with the third electrode portion 21*c* that covers a portion of the first lateral surface 15, the third electrode portion 21*c* that covers a portion of the second lateral surface 16 also has a reduced area. As a result, the stray capacitance between the coil incorporated in the multilayer body 10, and the first outer electrode 21 (the third electrode portion 21*c* on each lateral surface) is sufficiently reduced, thus further improving the radio frequency characteristics of the multilayer coil component 1.

Although the foregoing description is directed to the configuration of the first outer electrode 21, the second outer electrode 22 may be similar in configuration to the first outer electrode 21 as described below. More specifically, as illustrated in FIGS. 3, 4, and 6, the second outer electrode 22 may have a fourth electrode portion 22*a*, a fifth electrode portion 22*b*, and a sixth electrode portion 22*c*.

As illustrated in FIG. 6, the fourth electrode portion 22*a* may cover a portion of the second end surface 12. More specifically, the fourth electrode portion 22*a* may cover a region of the second end surface 12 including the edge that meets the first major surface 13, and may not cover a region of the second end surface 12 including the edge that meets the second major surface 14. The second end surface 12 may be thus exposed in the region including the edge that meets the second major surface 14.

Although the fourth electrode portion 22*a* has a height dimension (dimension in the height direction) $E_5$ that is constant in FIG. 6, the height dimension $E_5$ may not be constant. For example, as viewed in plan in the length direction, the fourth electrode portion 22*a* may have a substantially chevron shape with the height dimension $E_5$ that increases from its each widthwise end portion toward the central portion.

As illustrated in FIG. 3, the fifth electrode portion 22*b* may extend from the fourth electrode portion 22*a* to cover a portion of the first major surface 13. More specifically, the fifth electrode portion 22*b* may cover a region of the first major surface 13 including the edge that meets the second end surface 12, and may not cover a region of the first major surface 13 including the edge that meets the first end surface 11.

Although the fifth electrode portion 22*b* has a length dimension (dimension in the length direction) $E_4$ that is constant in FIG. 3, the length dimension $E_4$ may not be constant. For example, as viewed in plan in the height direction, the fifth electrode portion 22*b* may have a substantially chevron shape with the length dimension $E_4$ that increases from its each widthwise end portion toward the central portion.

As illustrated in FIG. 4, the sixth electrode portion 22*c* may extend from the fourth electrode portion 22*a* and the fifth electrode portion 22*b* to cover a portion of the first lateral surface 15. More specifically, the sixth electrode portion 22*c* may cover a region of the first lateral surface 15 including the vertex that meets the second end surface 12 and the first major surface 13, and may not cover a region of the first lateral surface 15 including the vertex that meets the second end surface 12 and the second major surface 14.

As described above, the second outer electrode 22 is disposed so as to cover not only a portion of the first major surface 13, which serves as the mounting surface, but also a portion of the first lateral surface 15. This configuration improves the mountability of the multilayer coil component 1. It is to be noted that the second outer electrode 22 may not cover the second major surface 14.

As viewed in plan in the width direction, the sixth electrode portion 22*c* may be substantially concave toward a vertex $P_2$ where a third edge 53 and a fourth edge 54 meet, the third edge 53 being the edge where the fourth electrode portion 22*a* and the sixth electrode portion 22*c* meet, the fourth edge 54 being the edge where the fifth electrode portion 22*b* and the sixth electrode portion 22*c* meet. Consequently, for the second outer electrode 22, the area of the sixth electrode portion 22*c* that covers a portion of the first lateral surface 15 decreases. This results in reduced stray capacitance between the coil incorporated in the multilayer body 10, and the second outer electrode 22 (sixth electrode portion 22*c*), leading to improved radio frequency characteristics of the multilayer coil component 1.

As viewed in plan in the width direction, the sixth electrode portion 22*c* has an area of preferably not less than about 20% and not more than about 80% (i.e., from about 20% to about 80%) of the area of a triangle $P_2Q_2R_2$, which is defined as a triangle formed by connecting the vertex $P_2$, a third endpoint $Q_2$, and a fourth endpoint $R_2$ in the sixth electrode portion 22*c* with each other by straight lines (dashed lines in FIG. 4), the third endpoint $Q_2$ being an endpoint lying on the third edge 53 and different from the vertex $P_2$, the fourth endpoint $R_2$ being an endpoint lying on the fourth edge 54 and different from the vertex $P_2$. If the sixth electrode portion 22*c* has an area of less than about 20% of the area of the triangle $P_2Q_2R_2$, this results in reduced area of the sixth electrode portion 22*c* involved in mounting the multilayer coil component 1, which may make it difficult to improve the mountability of the multilayer coil component 1. If the sixth electrode portion 22*c* has an area of more than about 80% of the area of the triangle $P_2Q_2R_2$, this results in increased stray capacitance between the coil incorporated in the multilayer body 10, and the second outer electrode 22 (sixth electrode portion 22*c*), which may cause degradation of the radio frequency characteristics of the multilayer coil component 1.

When it is herein stated that the sixth electrode portion 22*c* is substantially concave toward the vertex $P_2$ as viewed in plan in the width direction, this means that the contour connecting the third endpoint $Q_2$ and the fourth endpoint $R_2$ in the sixth electrode portion 22*c* is located closer to the vertex $P_2$ than the straight line (dashed line in FIG. 4) connecting the third endpoint $Q_2$ and the fourth endpoint $R_2$, except at the third endpoint $Q_2$ and the fourth endpoint $R_2$.

As viewed in plan in the width direction, the contour connecting the third endpoint $Q_2$ and the fourth endpoint $R_2$ in the sixth electrode portion 22*c* preferably has a substantially arcuate shape as illustrated in FIG. 4.

As viewed in plan in the width direction, the sixth electrode portion 22*c* has a dimension $E_6$ on the fourth edge 54 of preferably not less than about 40 μm and not more than about 145 μm (i.e., from about 40 μm to about 145 μm). If the dimension $E_6$ on the fourth edge 54 of the sixth electrode portion 22*c* is less than about 40 μm, this results in reduced area of the sixth electrode portion 22*c* involved in mounting the multilayer coil component 1, which may make it difficult to improve the mountability of the multilayer coil component 1. If the dimension $E_6$ on the fourth edge 54 of the sixth electrode portion 22*c* is more than about 145 μm, this results in increased stray capacitance between the coil incorporated in the multilayer body 10, and the second outer electrode 22 (sixth electrode portion 22*c*), which may cause degradation of the radio frequency characteristics of the multilayer coil component 1. It is to be noted that FIGS. 3 and 4 illustrate an exemplary state in which the dimension $E_6$ on the fourth edge 54 of the sixth electrode portion 22*c* is equal to the length dimension $E_4$ of the fifth electrode portion 22*b*.

As illustrated in FIG. 5, the sixth electrode portion 22*c* may extend from the fourth electrode portion 22*a* and the fifth electrode portion 22*b* to cover a portion of the second lateral surface 16. More specifically, the sixth electrode portion 22*c* may cover a region of the second lateral surface 16 including the vertex that meets the second end surface 12 and the first major surface 13, and may not cover a region of the second lateral surface 16 including the vertex that meets the second end surface 12 and the second major surface 14.

As viewed in plan in the width direction, the sixth electrode portion 22*c* that covers a portion of the second lateral surface 16 may be similar in shape (substantially concave shape) to the sixth electrode portion 22*c* that covers a portion of the first lateral surface 15. In this case, the second outer electrode 22 is disposed so as to cover not only a portion of the first major surface 13, which serves as the mounting surface, and a portion of the first lateral surface 15, but also a portion of the second lateral surface 16. This configuration further improves the mountability of the multilayer coil component 1. Further, for the second outer electrode 22, as with the sixth electrode portion 22*c* that covers a portion of the first lateral surface 15, the sixth electrode portion 22*c* that covers a portion of the second lateral surface 16 also has a reduced area. As a result, the stray capacitance between the coil incorporated in the multilayer body 10, and the second outer electrode 22 (the sixth electrode portion 22*c* on each lateral surface) is sufficiently reduced, thus further improving the radio frequency characteristics of the multilayer coil component 1.

The second outer electrode 22 may differ in configuration from the first outer electrode 21. For example, as viewed in plan in the width direction, the sixth electrode portion 22*c* of the second outer electrode 22 may not be substantially concave toward the vertex $P_2$. Further, the second outer electrode 22 may not be disposed so as to cover a portion of the first lateral surface 15 and a portion of the second lateral surface 16.

Preferred dimensions of the multilayer coil component 1, the multilayer body 10, the first outer electrode 21, and the second outer electrode 22 will be described below.

Although the multilayer coil component according to the present disclosure is not limited to a particular size, the multilayer coil component is preferably 0603, 0402, or 1005 in size.

(1) Multilayer Coil Component 1 of 0603 Size

A length dimension $L_2$ (dimension in the length direction in FIGS. 4 and 5) of the multilayer coil component 1 is preferably not less than about 0.57 mm. Further, the length dimension $L_2$ of the multilayer coil component 1 is preferably not more than about 0.63 mm (i.e., the length dimension $L_2$ is from about 0.57 mm to about 0.63 mm).

A width dimension $W_2$ (dimension in the width direction in FIG. 3) of the multilayer coil component 1 is preferably not less than about 0.27 mm. Further, the width dimension $W_2$ of the multilayer coil component 1 is preferably not more than about 0.33 mm (i.e., the width dimension $W_2$ is from about 0.27 mm to about 0.33 mm).

A height dimension $T_2$ (dimension in the height direction in FIG. 2) of the multilayer coil component 1 is preferably not less than about 0.27 mm. Further, the height dimension $T_2$ of the multilayer coil component 1 is preferably not more than about 0.33 mm (i.e., the height dimension $T_2$ is from about 0.27 mm to about 0.33 mm).

A length dimension $L_1$ (dimension in the length direction in FIGS. 4 and 5) of the multilayer body 10 is preferably not less than about 0.57 mm. Further, the length dimension $L_1$ of the multilayer body 10 is preferably not more than about 0.63 mm (i.e., the length dimension $L_1$ is from about 0.57 mm to about 0.63 mm).

A width dimension $W_1$ (dimension in the width direction in FIG. 3) of the multilayer body 10 is preferably not less than about 0.27 mm. Further, the width dimension $W_1$ of the multilayer body 10 is preferably not more than about 0.33 mm (i.e., the width dimension $W_1$ is from about 0.27 mm to about 0.33 mm).

A height dimension $T_1$ (dimension in the height direction in FIG. 2) of the multilayer body 10 is preferably not less than about 0.27 mm. Further, the height dimension $T_1$ of the multilayer body 10 is preferably not more than about 0.33 mm (i.e., the height dimension $T_1$ is from about 0.27 mm to about 0.33 mm).

The height dimension $E_2$ of the first electrode portion 21*a* of the first outer electrode 21 is preferably not less than about 0.10 mm and not more than about 0.20 mm (i.e., from about 0.10 mm to about 0.20 mm). This configuration reduces the stray capacitance due to the first outer electrode 21. If the height dimension $E_2$ is not constant, the maximum height dimension is preferably within the above-mentioned range.

The height dimension (dimension in the height direction in FIG. 6) $E_5$ of the fourth electrode portion 22*a* of the second outer electrode 22 is preferably not less than about 0.10 mm and not more than about 0.20 mm (i.e., from about 0.10 mm to about 0.20 mm). This configuration reduces the stray capacitance due to the second outer electrode 22. If the height dimension $E_5$ is not constant, the maximum height dimension is preferably within the above-mentioned range.

(2) Multilayer Coil Component 1 of 0402 Size

The length dimension $L_2$ of the multilayer coil component 1 is preferably not less than about 0.38 mm. Further, the length dimension $L_2$ of the multilayer coil component 1 is preferably not more than about 0.42 mm (i.e., the length dimension $L_2$ is from about 0.38 mm to about 0.42 mm).

The width dimension $W_2$ of the multilayer coil component 1 is preferably not less than about 0.18 mm. Further, the width dimension $W_2$ of the multilayer coil component 1 is preferably not more than about 0.22 mm (i.e., the width dimension $W_2$ is from about 0.18 mm to about 0.22 mm).

The height dimension $T_2$ of the multilayer coil component 1 is preferably not less than about 0.18 mm. Further, the height dimension $T_2$ of the multilayer coil component 1 is preferably not more than about 0.22 mm (i.e., the height dimension $T_2$ is from about 0.18 mm to about 0.22 mm).

The length dimension $L_1$ of the multilayer body 10 is preferably no less than about 0.38 mm and not more than about 0.42 mm (i.e., from about 0.38 mm to about 0.42 mm).

The width dimension $W_1$ of the multilayer body 10 is preferably not less than about 0.18 mm and not more than about 0.22 mm (i.e., from about 0.18 mm to about 0.22 mm).

The height dimension $T_1$ of the multilayer body 10 is preferably not less than about 0.18 mm and not more than about 0.22 mm (i.e., from about 0.18 mm to about 0.22 mm).

The height dimension $E_2$ of the first electrode portion 21*a* of the first outer electrode 21 is preferably not less than about 0.06 mm and not more than about 0.13 mm (i.e., from about 0.06 mm to about 0.13 mm). This configuration reduces the stray capacitance due to the first outer electrode 21. If the height dimension $E_2$ is not constant, the maximum height dimension is preferably within the above-mentioned range.

The height dimension $E_5$ of the fourth electrode portion 22*a* of the second outer electrode 22 is preferably not less than about 0.06 mm and not more than about 0.13 mm (i.e., from about 0.06 mm to about 0.13 mm). This configuration reduces the stray capacitance due to the second outer electrode 22. If the height dimension $E_5$ is not constant, the maximum height dimension is preferably within the above-mentioned range.

(3) Multilayer Coil Component 1 of 1005 Size

The length dimension $L_2$ of the multilayer coil component 1 is preferably not less than about 0.95 mm. Further, the length dimension $L_2$ of the multilayer coil component 1 is preferably not more than about 1.05 mm (i.e., the length dimension $L_2$ is from about 0.95 mm to about 1.05 mm).

The width dimension $W_2$ of the multilayer coil component 1 is preferably not less than about 0.45 mm. Further, the width dimension $W_2$ of the multilayer coil component 1 is preferably not more than about 0.55 mm (i.e., the width dimension $W_2$ is from about 0.45 mm to about 0.55 mm).

The height dimension $T_2$ of the multilayer coil component 1 is preferably not less than about 0.45 mm. Further, the height dimension $T_2$ of the multilayer coil component 1 is preferably not more than about 0.55 mm (i.e., the height dimension $T_2$ is from about 0.45 mm to about 0.55 mm).

The length dimension $L_1$ of the multilayer body 10 is preferably not less than about 0.95 mm and not more than about 1.05 mm (i.e., from about 0.95 mm to about 1.05 mm).

The width dimension $W_1$ of the multilayer body 10 is preferably not less than about 0.45 mm and not more than about 0.55 mm (i.e., from about 0.45 to about 0.55 mm).

The height dimension $T_1$ of the multilayer body 10 is preferably not less than about 0.45 mm and not more than about 0.55 mm (i.e., from about 0.45 to about 0.55).

The height dimension $E_2$ of the first electrode portion 21*a* of the first outer electrode 21 is preferably not less than about 0.15 mm and not more than about 0.33 mm (i.e., from about 0.15 mm to about 0.33 mm). This configuration reduces the stray capacitance due to the first outer electrode 21. If the height dimension $E_2$ is not constant, the maximum height dimension is preferably within the above-mentioned range.

The height dimension $E_5$ of the fourth electrode portion 22*a* of the second outer electrode 22 is preferably not less than about 0.15 mm and not more than about 0.33 mm (i.e., from about 0.15 mm to about 0.33 mm). This configuration reduces the stray capacitance due to the second outer electrode 22. If the height dimension $E_5$ is not constant, the maximum height dimension is preferably within the above-mentioned range.

Figure 7:
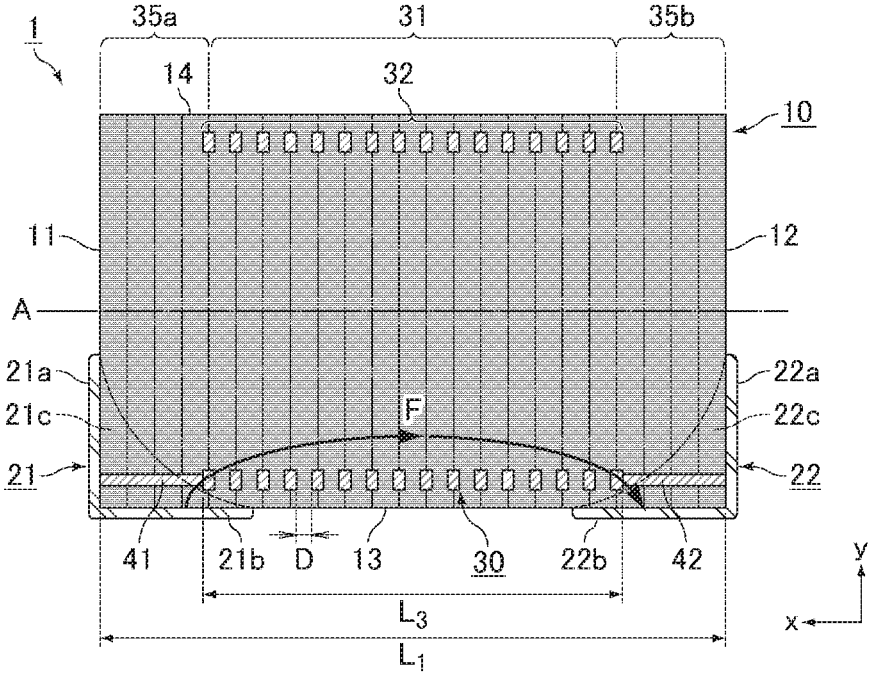
FIG. 7 is a schematic cross-sectional view taken in the length direction of the multilayer coil component illustrated in FIG. 1.

FIG. 7 is a schematic cross-sectional view taken in the length direction of the multilayer coil component illustrated in FIG. 1. As illustrated in FIG. 7, the multilayer body 10 is formed by stacking plural insulating layers 31, plural insulating layers 35*a*, and plural insulating layers 35*b* in the length direction. Although the boundaries between these insulating layers are indicated by dashed lines in FIG. 7 for the convenience of illustration, these boundaries may not appear clearly in actuality.

The multilayer body 10 includes a coil 30 incorporated therein. The coil 30 is formed by electrically connecting plural coil conductors 32 that are stacked in the length direction together with the insulating layers 31. More specifically, the coil 30 is formed by electrically connecting plural coil conductors 32 each disposed between the insulating layers 31 (with some of the coil conductors 32 being disposed between the insulating layer 31 and the insulating layer 35*a*, and between the insulating layer 31 and the insulating layer 35*b*).

The stacking direction of the multilayer body 10 (the direction in which the insulating layers 31 and the coil conductors 32 are stacked) corresponds to the length direction. FIG. 7 does not precisely depict the shape of the coil 30, the location of each coil conductor 32, the connection between the coil conductors 32, and other details. For example, the coil conductors 32 that are adjacent to each other in the stacking direction are connected with each other by a via conductor as described later.

The coil 30 has a coil axis A. The coil axis A extends in the stacking direction, and penetrates the area between the first end surface 11 and the second end surface 12. The stacking direction, and the direction of the coil axis A are parallel to the first major surface 13 serving as the mounting surface.

The first outer electrode 21 and the coil 30 are connected with each other by a first connecting conductor 41 that penetrates the insulating layers 35*a*. More specifically, the first outer electrode 21, and the coil conductor 32 facing the first outer electrode 21 are connected with each other by the first connecting conductor 41 that penetrates the insulating layers 35*a*.

The first connecting conductor 41 preferably connects the first outer electrode 21 and the coil 30 in a substantially linear manner. Further, as viewed in plan in the stacking direction, preferably, the first connecting conductor 41 overlaps each coil conductor 32, and is located closer to the first major surface 13 serving as the mounting surface than the coil axis A. The above-mentioned configurations facilitate the electrical connection between the first outer electrode 21 and the coil 30.

Plural first connecting conductors 41 may be disposed. In this case, the first outer electrode 21 (first electrode portion 21*a*) and the coil 30 (coil conductor 32) are connected with each other at plural locations by the first connecting conductor 41.

The second outer electrode 22 and the coil 30 are connected with each other by a second connecting conductor 42 that penetrates the insulating layers 35*b*. More specifically, the second outer electrode 22, and the coil conductor 32 facing the second outer electrode 22 are connected with each other by the second connecting conductor 42 that penetrates the insulating layers 35*b*.

The second connecting conductor 42 preferably connects the second outer electrode 22 and the coil 30 in a substantially linear manner. Further, as viewed in plan in the stacking direction, preferably, the second connecting conductor 42 overlaps each coil conductor 32, and is located closer to the first major surface 13 serving as the mounting surface than the coil axis A. The above-mentioned configurations facilitate the electrical connection between the second outer electrode 22 and the coil 30.

Plural second connecting conductors 42 may be disposed. In this case, the second outer electrode 22 (fourth electrode portion 22*a*) and the coil 30 (coil conductor 32) are connected with each other at plural locations by the second connecting conductor 42.

The region where the coil conductors 32 are disposed has a dimension $L_3$ in the stacking direction of preferably not less than about 85% and not more than about 95% (i.e., from about 85% to about 95%), more preferably not less than about 90% and not more than about 95% (i.e., from about 90% to about 95%) of the length dimension $L_1$ of the multilayer body 10. In this regard, the dimension $L_3$ in the stacking direction of the region where the coil conductors 32 are disposed refers to the distance in the stacking direction from the coil conductor 32 connected to the first outer electrode 21 by the first connecting conductor 41, to the coil conductor 32 connected to the second outer electrode 22 by the second connecting conductor 42 (which distance includes the respective thicknesses of the above-mentioned two coil conductors 32). If the dimension $L_3$ of the region where the coil conductors 32 are disposed is less than about 85% of the length dimension $L_1$ of the multilayer body 10, this results in increased electrostatic capacity of the coil 30, which may cause degradation of the radio frequency characteristics of the multilayer coil component 1. If the dimension $L_3$ of the region where the coil conductors 32 are disposed is more than about 95% of the length dimension $L_1$ of the multilayer body 10, this results in increased stray capacitance between the coil 30 and each of the first and second outer electrodes 21 and 22, which may cause degradation of the radio frequency characteristics of the multilayer coil component 1. Therefore, for the multilayer coil component 1, if the region where the coil conductors 32 are disposed has the dimension $L_3$ set within the above-mentioned range, this configuration further improves the radio frequency characteristics of the multilayer coil component 1, in combination with the operational effect due to the shape (substantially concave shape) of the third electrode portion 21*c* of the first outer electrode 21.

Preferably, the number of stacked coil conductors 32 is greater than or equal to 50, and as viewed in plan in the width direction, the number of stacked coil conductors 32 overlapping the third electrode portion 21*c* covering a portion of the first lateral surface 15 is less than or equal to 10. For the multilayer coil component 1, if the coil conductors 32 are stacked in a manner that satisfies the above-mentioned range, this configuration further improves the radio frequency characteristics of the multilayer coil component 1, in combination with the operational effect due to the shape (substantially concave shape) of the third electrode portion 21*c*. Although a portion of the contours of the third electrode portion 21*c* covering a portion of the first lateral surface 15 is indicated by a dashed line in FIG. 7 for the convenience of illustration, the contours do not actually appear in the cross-section of FIG. 7.

If the third electrode portion 21*c* covers a portion of the second lateral surface 16, it is preferable that as viewed in plan in the width direction, the number of stacked coil conductors 32 overlapping the third electrode portion 21*c* covering a portion of the second lateral surface 16 be less than or equal to 10.

If the second outer electrode 22 has the sixth electrode portion 22*c* that covers a portion of the first lateral surface 15, it is preferable that as viewed in plan in the width direction, the number of stacked coil conductors 32 overlapping the sixth electrode portion 22*c* covering a portion of the first lateral surface 15 be less than or equal to 10. Although a portion of the contours of the sixth electrode portion 22*c* covering a portion of the first lateral surface 15 is indicated by a dashed line in FIG. 7 for the convenience of illustration, the contours do not actually appear in the cross-section of FIG. 7.

If the sixth electrode portion 22*c* covers a portion of the second lateral surface 16, it is preferable that as viewed in plan in the width direction, the number of stacked coil conductors 32 overlapping the sixth electrode portion 22*c* covering a portion of the second lateral surface 16 be less than or equal to 10.

The distance D between coil conductors that are adjacent to each other in the stacking direction is preferably not less than about 3 μm and not more than about 10 μm (i.e., from about 3 μm to about 10 μm). This configuration helps to increase the number of turns in the coil 30. This results in increased impedance, and also increased transmission coefficient S21 in the radio frequency range. The distance D between coil conductors that are adjacent to each other in the stacking direction means the shortest distance between coil conductors that are connected with each other by a via conductor described later. As such, the distance D between coil conductors that are adjacent to each other in the stacking direction is not necessarily the same as the distance between coil conductors involved in the generation of a stray capacitance.

Figure 8:
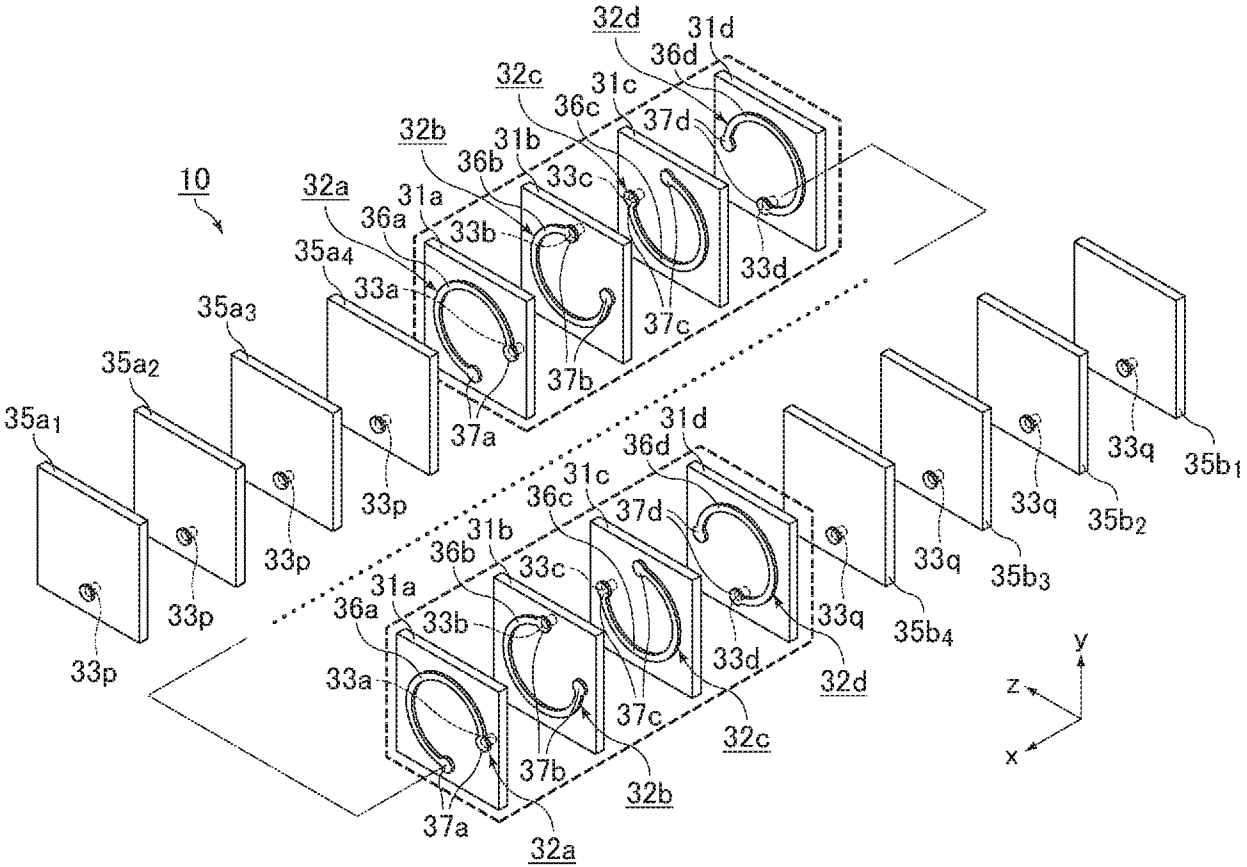
FIG. 8 is an exploded schematic perspective view of an exemplary multilayer body constituting the multilayer coil component illustrated in FIG. 1.
Figure 9:
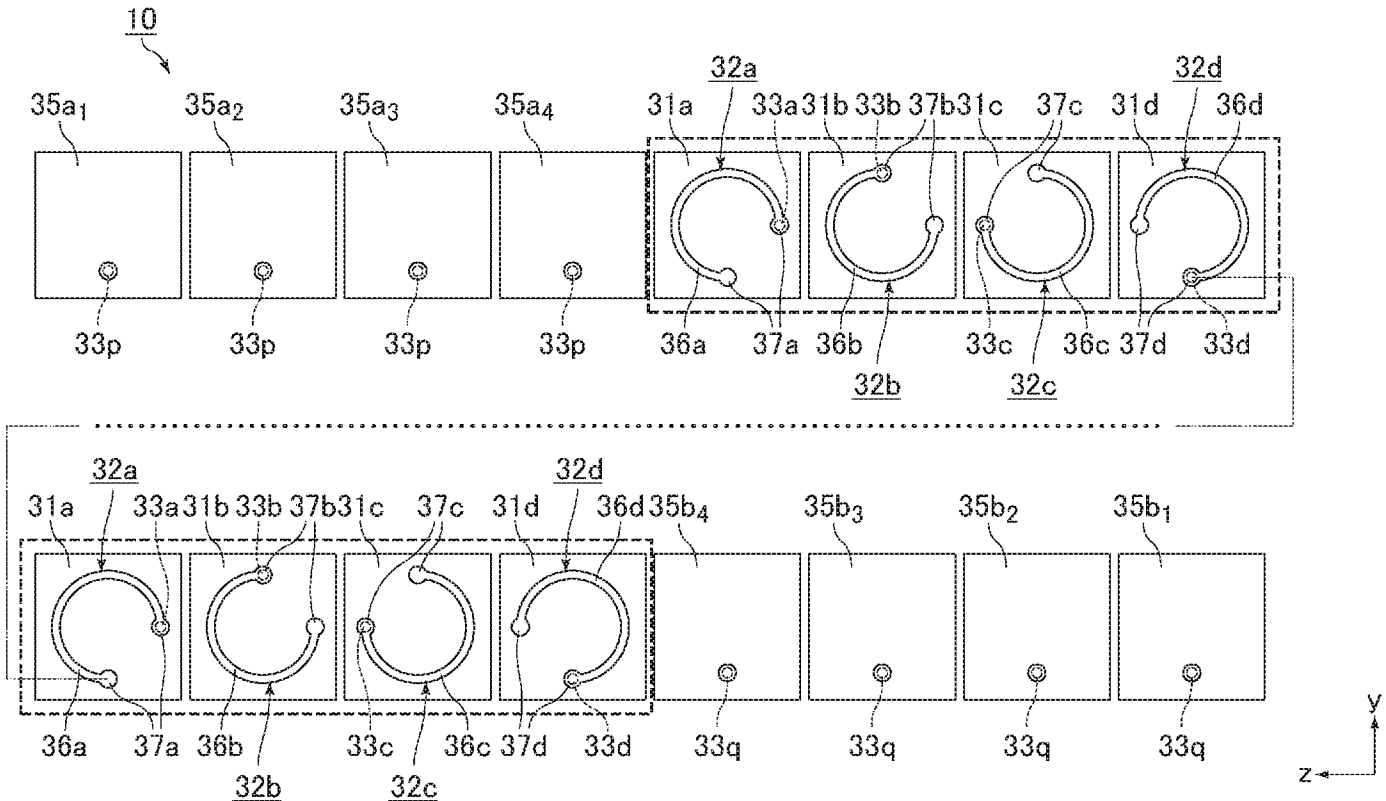
FIG. 9 is an exploded schematic plan view of the exemplary multilayer body constituting the multilayer coil component illustrated in FIG. 1.

FIG. 8 is an exploded schematic perspective view of an exemplary multilayer body constituting the multilayer coil component illustrated in FIG. 1. FIG. 9 is an exploded schematic plan view of the exemplary multilayer body constituting the multilayer coil component illustrated in FIG. 1.

As illustrated in FIGS. 8 and 9, the multilayer body 10 includes, as the insulating layers 31 illustrated in FIG. 7, an insulating layer 31*a*, an insulating layer 31*b*, an insulating layer 31*c*, and an insulating layer 31*d*. The multilayer body 10 includes, as the insulating layers 35*a* illustrated in FIG. 7, an insulating layer $\mathbf{35}a_1$, an insulating layer $\mathbf{35}a_2$, an insulating layer $\mathbf{35}a_3$, and an insulating layer $\mathbf{35}a_4$. The multilayer body 10 includes, as the insulating layers 35*b* illustrated in FIG. 7, an insulating layer $\mathbf{35}b_1$, an insulating layer $\mathbf{35}b_2$, an insulating layer $\mathbf{35}b_3$, and an insulating layer $\mathbf{35}b_4$.

The coil 30 includes, as the coil conductors 32 illustrated in FIG. 7, a coil conductor 32*a*, a coil conductor 32*b*, a coil conductor 32*c*, and a coil conductor 32*d*.

The coil conductor 32*a*, the coil conductor 32*b*, the coil conductor 32*c*, and the coil conductor 32*d* are respectively disposed on the major surfaces of the insulating layer 31*a*, the insulating layer 31*b*, the insulating layer 31*c*, and the insulating layer 31*d*.

The coil conductor 32*a*, the coil conductor 32*b*, the coil conductor 32*c*, and the coil conductor 32*d* each have a length equal to a three-quarter turn of the coil 30. In other words, the number of stacked coil conductors that form three turns of the coil 30 is four. For the multilayer body 10, the coil conductor 32*a*, the coil conductor 32*b*, the coil conductor 32*c*, and the coil conductor 32*d* together constitute a single unit (equivalent to three turns), and such single units are repeatedly stacked.

The coil conductor 32*a* has a line portion 36*a*, and a land portion 37*a* disposed in an end portion of the line portion 36*a*. The coil conductor 32*b* has a line portion 36*b*, and a land portion 37*b* disposed in an end portion of the line portion 36*b*. The coil conductor 32*c* has a line portion 36*c*, and a land portion 37*c* disposed in an end portion of the line portion 36*c*. The coil conductor 32*d* has a line portion 36*d*, and a land portion 37*d* disposed in an end portion of the line portion 36*d*.

The insulating layer 31*a*, the insulating layer 31*b*, the insulating layer 31*c*, and the insulating layer 31*d* are respectively provided with a via conductor 33*a*, a via conductor 33*b*, a via conductor 33*c*, and a via conductor 33*d*, which are each disposed so as to penetrate the corresponding insulating layer in the stacking direction.

The insulating layer 31*a* provided with the coil conductor 32*a* and the via conductor 33*a*, the insulating layer 31*b* provided with the coil conductor 32*b* and the via conductor 33*b*, the insulating layer 31*c* provided with the coil conductor 32*c* and the via conductor 33*c*, and the insulating layer 31*d* provided with the coil conductor 32*d* and the via conductor 33*d* together constitute a single unit (the portion bounded by dashed lines in FIGS. 8 and 9), and such single units are repeatedly stacked. Thus, the land portion 37*a* of the coil conductor 32*a*, the land portion 37*b* of the coil conductor 32*b*, the land portion 37*c* of the coil conductor 32*c*, and the land portion 37*d* of the coil conductor 32*d* are connected by the via conductor 33*a*, the via conductor 33*b*, the via conductor 33*c*, and the via conductor 33*d*. In other words, the respective land portions of coil conductors that are adjacent to each other in the stacking direction are connected with each other by a via conductor.

The coil 30 having a substantially solenoid shape and incorporated in the multilayer body 10 is thus formed as described above.

As viewed in plan in the stacking direction, the coil 30 including the coil conductor 32*a*, the coil conductor 32*b*, the coil conductor 32*c*, and the coil conductor 32*d* may have a substantially circular shape, or may have a substantially polygonal shape. If the coil 30 has a substantially polygonal shape as viewed in plan in the stacking direction, the diameter of a circle corresponding to the area of the polygonal shape is defined as the coil diameter of the coil 30, and the axis passing through the center of gravity of the polygonal shape and extending in the stacked direction is defined as the coil axis of the coil 30.

Preferably, as viewed in plan in the stacking direction, the diameters of the land portion 37*a*, the land portion 37*b*, the land portion 37*c*, and the land portion 37*d* are respectively greater than the line widths of the line portion 36*a*, the line portion 36*b*, the line portion 36*c*, and the line portion 36*d* as illustrated in FIG. 9.

As viewed in plan in the stacking direction, each of the land portion 37*a*, the land portion 37*b*, the land portion 37*c*, and the land portion 37*d* may have a substantially circular shape as illustrated in FIG. 9, or may have a substantially polygonal shape. If each of the land portion 37*a*, the land portion 37*b*, the land portion 37*c*, and the land portion 37*d* has a substantially polygonal shape as viewed in plan in the stacking direction, the diameter of the circle corresponding to the area of the polygonal shape is defined as the diameter of the land portion.

Each of the insulating layer $\mathbf{35}a_1$, the insulating layer $\mathbf{35}a_2$, the insulating layer $\mathbf{35}a_3$, and the insulating layer $\mathbf{35}a_4$ is provided with a via conductor 33*p* disposed so as to penetrate the insulating layer. A land portion connected to the via conductor 33*p* may be disposed on the major surface of each of the insulating layer $\mathbf{35}a_1$, the insulating layer $\mathbf{35}a_2$, the insulating layer $\mathbf{35}a_3$, and the insulating layer $\mathbf{35}a_4$.

The insulating layer $\mathbf{35}a_1$ provided with the via conductor 33*p*, the insulating layer $\mathbf{35}a_2$ provided with the via conductor 33*p*, the insulating layer $\mathbf{35}a_3$ provided with the via conductor 33*p*, and the insulating layer $\mathbf{35}a_4$ provided with the via conductor 33*p* are stacked so as to overlap the insulating layer 31*a* that is provided with the coil conductor 32*a* and the via conductor 33*a*. Thus, the via conductors 33*p* connect with each other to form the first connecting conductor 41, and the first connecting conductor 41 is exposed on the first end surface 11. As a result, the first outer electrode 21 (first electrode portion 21*a*) and the coil 30 (coil conductor 32*a*) are connected with each other by the first connecting conductor 41.

The first connecting conductor 41 is preferably connected to a portion of the coil conductor 32*a* located closest to the first major surface 13. This configuration makes it possible to sufficiently reduce the area of the first electrode portion 21*a* of the first outer electrode 21. As a result, the stray capacitance between the coil 30 and the first outer electrode 21 (first electrode portion 21*a*) is sufficiently reduced, thus further improving the radio frequency characteristics of the multilayer coil component 1.

As described above, the first connecting conductor 41 preferably connects the first outer electrode 21 (first electrode portion 21*a*) and the coil 30 in a substantially linear manner. When it is herein stated that the first connecting conductor 41 connects the first outer electrode 21 and the coil 30 in a substantially linear manner, this means that as viewed in plan in the stacked direction, the via conductors 33*p* constituting the first connecting conductor 41 overlap each other, and does not necessarily mean that the via conductors 33*p* are arranged strictly linearly.

Each of the insulating layer 35$b_1$, the insulating layer 35$b_2$, the insulating layer 35$b_3$, and the insulating layer 35$b_4$ is provided with a via conductor 33*q* disposed so as to penetrate the insulating layer. A land portion connected to the via conductor 33*q* may be disposed on the major surface of each of the insulating layer 35$b_1$, the insulating layer 35$b_2$, the insulating layer 35$b_3$, and the insulating layer 35$b_4$.

The insulating layer 35$b_1$ provided with the via conductor 33*q*, the insulating layer 35$b_2$ provided with the via conductor 33*q*, the insulating layer 35$b_3$ provided with the via conductor 33*q*, and the insulating layer 35$b_4$ provided with the via conductor 33*q* are stacked so as to overlap the insulating layer 31*d* that is provided with the coil conductor 32*d* and the via conductor 33*d*. Thus, the via conductors 33*q* connect with each other to form the second connecting conductor 42, and the second connecting conductor 42 is exposed on the second end surface 12. As a result, the second outer electrode 22 (fourth electrode portion 22*a*) and the coil 30 (coil conductor 32*d*) are connected with each other by the second connecting conductor 42.

The second connecting conductor 42 is preferably connected to a portion of the coil conductor 32*d* located closest to the first major surface 13. This configuration makes it possible to sufficiently reduce the area of the fourth electrode portion 22*a* of the second outer electrode 22. As a result, the stray capacitance between the coil 30 and the second outer electrode 22 (fourth electrode portion 22*a*) is sufficiently reduced, thus further improving the radio frequency characteristics of the multilayer coil component 1.

As described above, the second connecting conductor 42 preferably connects the second outer electrode 22 (fourth electrode portion 22*a*) and the coil 30 in a substantially linear manner. When it is herein stated that the second connecting conductor 42 connects the second outer electrode 22 and the coil 30 in a substantially linear manner, this means that as viewed in plan in the stacked direction, the via conductors 33*q* constituting the second connecting conductor 42 overlap each other, and does not necessarily mean that the via conductors 33*q* are arranged strictly linearly.

If the via conductors 33*p* constituting the first connecting conductor 41, and the via conductors 33*q* constituting the second connecting conductor 42 are each connected with a land portion, the shape of each of the first and second connecting conductors 41 and 42 in this case means a shape excluding the land portion.

Figure 10:
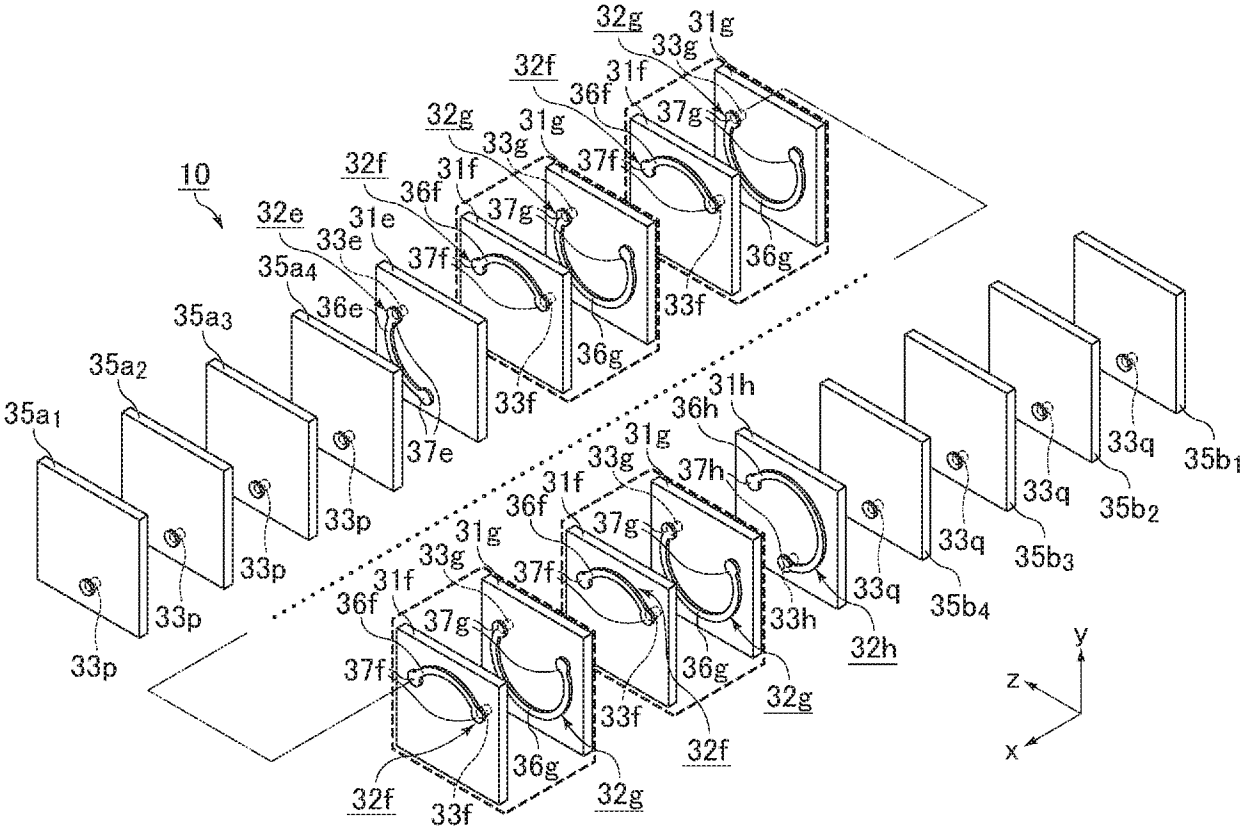
FIG. 10 is an exploded schematic perspective view of another exemplary multilayer body constituting the multilayer coil component illustrated in FIG. 1.
Figure 11:
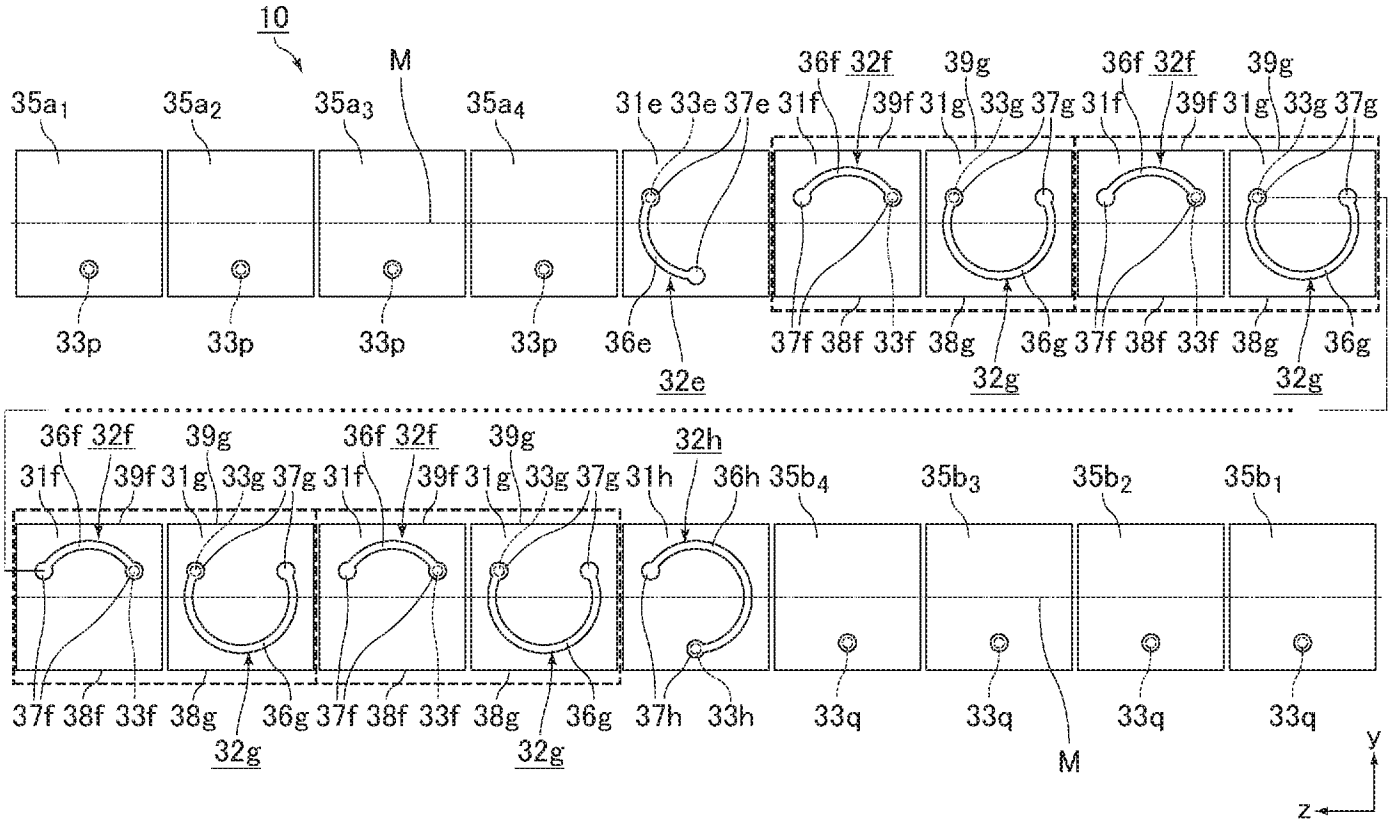
FIG. 11 is an exploded schematic plan view of the other exemplary multilayer body constituting the multilayer coil component illustrated in FIG. 1.

Although FIGS. 8 and 9 depict an exemplary pattern in which the number of stacked coil conductors that form three turns of the coil 30 is four, another pattern may be employed in which the number of stacked coil conductors that form one turn of the coil 30 is two. FIG. 10 is an exploded schematic perspective view of another exemplary multilayer body constituting the multilayer coil component illustrated in FIG. 1. FIG. 11 is an exploded schematic plan view of the other exemplary multilayer body constituting the multilayer coil component illustrated in FIG. 1.

As illustrated in FIGS. 10 and 11, the multilayer body 10 includes, as the insulating layers 31 illustrated in FIG. 7, an insulating layer 31*e*, an insulating layer 31*f*, an insulating layer 31*g*, and an insulating layer 31*h*. The multilayer body 10 includes, as the insulating layers 35*a* illustrated in FIG. 7, the insulating layer 35$a_1$, the insulating layer 35$a_2$, the insulating layer 35$a_3$, and the insulating layer 35$a_4$. The multilayer body 10 includes, as the insulating layers 35*b* illustrated in FIG. 7, the insulating layer 35$b_1$, the insulating layer 35$b_2$, the insulating layer 35$b_3$, and the insulating layer 35$b_4$.

The coil 30 includes, as the coil conductors 32 illustrated in FIG. 7, a coil conductor 32*e*, a coil conductor 32*f*, a coil conductor 32*g*, and a coil conductor 32*h*.

The coil conductor 32*e*, the coil conductor 32*f*, the coil conductor 32*g*, and the coil conductor 32*h* are respectively disposed on the major surfaces of the insulating layer 31*e*, the insulating layer 31*f*, the insulating layer 31*g*, and the insulating layer 31*h*.

For the pattern as illustrated in FIGS. 10 and 11, the number of stacked coil conductors that form one turn of the coil 30 is two. For the multilayer body 10, the coil conductor 32*f* and the coil conductor 32*g* together constitute a single unit (equivalent to one turn), and such single units are repeatedly stacked.

The coil conductor 32*e* has a line portion 36*e*, and a land portion 37*e* disposed in an end portion of the line portion 36*e*. The coil conductor 32*f* has a line portion 36*f*, and a land portion 37*f* disposed in an end portion of the line portion 36*f*. The coil conductor 32*g* has a line portion 36*g*, and a land portion 37*g* disposed in an end portion of the line portion 36*g*. The coil conductor 32*h* has a line portion 36*h*, and a land portion 37*h* disposed in an end portion of the line portion 36*h*.

The insulating layer 31*e*, the insulating layer 31*f*, the insulating layer 31*g*, and the insulating layer 31*h* are respectively provided with a via conductor 33*e*, a via conductor 33*f*, a via conductor 33*g*, and a via conductor 33*h*, which are each disposed so as to penetrate the corresponding insulating layer in the stacking direction.

The insulating layer 31*f* provided with the coil conductor 32*f* and the via conductor 33*f*, and the insulating layer 31*g* provided with the coil conductor 32*g* and the via conductor 33*g* together constitute a single unit (the portion bounded by dashed lines in FIGS. 10 and 11), and such single units are repeatedly stacked. Thus, the land portion 37*f* of the coil conductor 32*f*, and the land portion 37*g* of the coil conductor 32*g* are connected by the via conductor 33*f* and the via conductor 33*g*.

As described above, each two coil conductors 32*f* and 32*g* together make up one turn of the coil 30, and with respect to the stacking direction, the respective line portions 36*f* and 36*g* of the coil conductors 32*f* and 32*g* do not face each other with an insulating layer interposed therebetween. As compared with the pattern (three-quarter-turn shape) as illustrated in FIGS. 8 and 9, the above-mentioned pattern results in increased distance between coil conductors involved in the generation of a stray capacitance (the distance between line portions that face each other in the stacking direction, which in FIGS. 10 and 11 corresponds to each of the distance between the line portions 36*f* that face each other in the stacking direction and the distance between the line portions 36*g* that face each other in the stacking direction). This leads to reduced stray capacitance and consequently improved radio frequency characteristics of the multilayer coil component 1.

The insulating layer 31*e* provided with the coil conductor 32*e* and the via conductor 33*e*, and the insulating layer 31*f* provided with the coil conductor 32*f* and the via conductor 33*f* are stacked on each other. Thus, the land portion 37*e* of the coil conductor 32*e*, and the land portion 37*f* of the coil conductor 32*f* are connected by the via conductor 33*e*.

The insulating layer 31*g* provided with the coil conductor 32*g* and the via conductor 33*g*, and the insulating layer 31*h* provided with the coil conductor 32*h* and the via conductor 33*h* are stacked on each other. Thus, the land portion 37*g* of the coil conductor 32*g*, and the land portion 37*h* of the coil conductor 32*h* are connected by the via conductor 33*g*.

The coil 30 having a substantially solenoid shape and incorporated in the multilayer body 10 is thus formed as described above.

As viewed in plan in the stacking direction, the coil 30 including the coil conductor 32*e*, the coil conductor 32*f*, the coil conductor 32*g*, and the coil conductor 32*h* may have a substantially circular shape, or may have a substantially polygonal shape.

Preferably, as viewed in plan in the stacking direction, the diameters of the land portion 37*e*, the land portion 37*f*, the land portion 37*g*, and the land portion 37*h* are respectively greater than the line widths of the line portion 36*e*, the line portion 36*f*, the line portion 36*g*, and the line portion 36*h* as illustrated in FIG. 11.

As viewed in plan in the stacking direction, each of the land portion 37*e*, the land portion 37*f*, the land portion 37*g*, and the land portion 37*h* may have a substantially circular shape as illustrated in FIG. 11, or may have a substantially polygonal shape.

The insulating layer 35$a_1$ provided with the via conductor 33*p*, the insulating layer 35$a_2$ provided with the via conductor 33*p*, the insulating layer 35$a_3$ provided with the via conductor 33*p*, and the insulating layer 35$a_4$ provided with the via conductor 33*p* are stacked so as to overlap the insulating layer 31*e* that is provided with the coil conductor 32*e* and the via conductor 33*e*. Thus, the via conductors 33*p* connect with each other to form the first connecting conductor 41, and the first connecting conductor 41 is exposed on the first end surface 11. As a result, the first outer electrode 21 (first electrode portion 21*a*) and the coil 30 (coil conductor 32*e*) are connected with each other by the first connecting conductor 41.

The insulating layer 35$b_1$ provided with the via conductor 33*q*, the insulating layer 35$b_2$ provided with the via conductor 33*q*, the insulating layer 35$b_3$ provided with the via conductor 33*q*, and the insulating layer 35$b_4$ provided with the via conductor 33*q* are stacked so as to overlap the insulating layer 31*h* that is provided with the coil conductor 32*h* and the via conductor 33*h*. Thus, the via conductors 33*q* connect with each other to form the second connecting conductor 42, and the second connecting conductor 42 is exposed on the second end surface 12. As a result, the second outer electrode 22 (fourth electrode portion 22*a*) and the coil 30 (coil conductor 32*h*) are connected with each other by the second connecting conductor 42.

For the multilayer coil component 1, passing electric current from the first outer electrode 21 to the second outer electrode 22 causes an electric field F as illustrated in FIG. 7 to form in a region of the multilayer body 10 near the first major surface 13, between the second electrode portion 21*b* and the fifth electrode portion 22*b*. If the land portion of each coil conductor (its portion with a relatively large area) is positioned to cross the electric field F, this may lead to increased stray capacitance and consequently degraded radio frequency characteristics of the multilayer coil component 1.

The configuration illustrated in FIGS. 10 and 11 is now considered from this point of view. As viewed in plan in the width direction, the land portions of coil conductors connected with each other by via conductors are located in the upper half region of the multilayer body 10 located opposite to the first major surface 13. More specifically, as viewed in plan in the width direction, the land portion 37*e* and the land portion 37*f* that are connected with each other by the via conductor 33*e*, the land portion 37*f* and the land portion 37*g* that are connected with each other by the via conductor 33*f*, the land portion 37*g* and the land portion 37*f* that are connected with each other by the via conductor 33*g*, and the land portion 37*g* and the land portion 37*h* that are connected with each other by the via conductor 33*g* are located in the upper half region of the multilayer body 10 located opposite to the first major surface 13. This configuration ensures that the land portions are not positioned to cross the electric field F. This helps to sufficiently reduce stray capacitance, thus further improving the radio frequency characteristics of the multilayer coil component 1.

As illustrated in FIG. 11, a portion of the multilayer body 10 that will become the first major surface 13 is indicated as a side 38*f* of the insulating layer 31*f* and a side 38*g* of the insulating layer 31*g*. A side 39*f* and a side 39*g*, which are respectively located opposite to the side 38*f* and the side 38*g*, correspond to a portion of the multilayer body 10 that will become the second major surface 14. The upper half region of the multilayer body 10 located opposite to the first major surface 13 means a region of the multilayer body 10 closer to the sides 39*f* and 39*g* than a middle line M, which is located at the middle position (the middle position in the height direction) between the sides 38*f* and 38*g* that will become the first major surface 13 and the sides 39*f* and 39*g* that will become the second major surface 14.

Land portions not involved in the connection between coil conductors, such as the land portion 37*e* connected to the via conductors 33*p* constituting the first connecting conductor 41 and the land portion 37*h* connected to the via conductors 33*q* constituting the second connecting conductor 42 (i.e., land portions involved in connecting coil conductors to the first connecting conductor 41 and to the second connecting conductor 42) may not be located in the upper half region of the multilayer body 10 located opposite to the first major surface 13.

The following describes preferred dimensions for each of the coil conductor 32*a*, the coil conductor 32*b*, the coil conductor 32*c*, the coil conductor 32*d*, the coil conductor 32*e*, the coil conductor 32*f*, the coil conductor 32*g*, and the coil conductor 32*h*, and for each of the first connecting conductor 41 and the second connecting conductor 42.

As viewed in plan in the stacking direction, each coil conductor has an inside diameter (coil diameter) of preferably not less than about 15% and not more than about 40% (i.e., from about 15% to about 40%) of the width dimension $W_1$ of the multilayer body 10.

As viewed in plan in the stacking direction, the line portion of each coil conductor has a line width of preferably not less than about 10% and not more than about 30% (i.e., from about 10% to about 30%) of the width dimension $W_1$ of the multilayer body 10. If the line width of the line portion is less than about 10% of the width dimension $W_1$ of the multilayer body 10, this may result in increased direct-current resistance of the coil 30. If the line width of the line portion is more than about 30% of the width dimension $W_1$ of the multilayer body 10, this may result in increased electrostatic capacity of the coil 30 and consequently degraded radio frequency characteristics of the multilayer coil component 1.

Each connecting conductor has a length dimension (dimension in the length direction) of preferably not less than about 2.5% and not more than about 7.5% (i.e., from about 2.5% to about 7.5%), more preferably not less than about 2.5% and not more than about 5.0% (i.e., from about 2.5% to about 5.0%) of the length dimension $L_1$ of the multilayer body 10. This configuration results in reduced inductance of each connecting conductor, leading to improved radio frequency characteristics of the multilayer coil component 1.

Each connecting conductor has a width dimension (dimension in the width direction) of preferably not less than about 8% and not more than about 20% (i.e., from about 8% to about 20%) of the width dimension $W_1$ of the multilayer body 10.

Specific examples of preferred dimensions of each coil conductor and each connecting conductor will be described below separately for each of the multilayer coil component 1 of 0603 size, the multilayer coil component 1 of 0402 size, and the multilayer coil component 1 of 1005 size.

(1) Multilayer Coil Component 1 of 0603 Size

As viewed in plan in the stacking direction, each coil conductor has an inside diameter (coil diameter) of preferably not less than about 50 μm and not more than about 100 μm (i.e., from about 50 μm to about 100 μm).

As viewed in plan in the stacking direction, the line portion of each coil conductor has a line width of preferably not less than about 30 μm and not more than about 90 μm (i.e., from about 30 μm to about 90 μm), more preferably not less than about 30 μm and not more than about 70 μm (i.e., from about 30 μm to about 70 μm).

Each connecting conductor has a length dimension of preferably not less than about 15 μm and not more than about 45 μm (i.e., from about 15 μm to about 45 μm), more preferably not less than about 15 μm and not more than about 30 μm (i.e., from about 15 μm to about 30 μm).

Each connecting conductor has a width dimension of preferably not less than about 30 μm and not more than about 60 μm (i.e., from about 30 μm to about 60 μm).

(2) Multilayer Coil Component 1 of 0402 Size

As viewed in plan in the stacking direction, each coil conductor has an inside diameter (coil diameter) of preferably not less than about 30 μm and not more than about 70 μm (i.e., from about 30 μm to about 70 μm).

As viewed in plan in the stacking direction, the line portion of each coil conductor has a line width of preferably not less than about 20 μm and not more than about 60 μm (i.e., from about 20 μm to about 60 μm), more preferably not less than about 20 μm and not more than about 50 μm (i.e., from about 20 μm to about 50 μm).

Each connecting conductor has a length dimension of preferably not less than about 10 μm and not more than about 30 μm (i.e., from about 10 μm to about 30 μm), more preferably not less than about 10 μm and not more than about 25 μm (i.e., from about 10 μm to about 25 μm).

Each connecting conductor has a width dimension of preferably not less than about 20 μm and not more than about 40 μm (i.e., from about 20 μm to about 40 μm).

(3) Multilayer Coil Component 1 of 1005 Size

As viewed in plan in the stacking direction, each coil conductor has an inside diameter (coil diameter) of preferably not less than about 80 μm and not more than about 170 μm (i.e., from about 80 μm to about 170 μm).

As viewed in plan in the stacking direction, the line portion of each coil conductor has a line width of preferably not less than about 50 μm and not more than about 150 μm (i.e., from about 50 μm to about 150 μm), more preferably not less than about 50 μm and not more than about 120 μm (i.e., from about 50 μm to about 120 μm).

Each connecting conductor has a length dimension of preferably not less than about 25 μm and not more than about 75 μm (i.e., from about 25 μm to about 75 μm), more preferably not less than about 25 μm and not more than about 50 μm (i.e., from about 25 μm to about 50 μm).

Each connecting conductor has a width dimension of preferably not less than about 40 μm and not more than about 100 μm (i.e., from about 40 μm to about 100 μm).

Method for Manufacturing Multilayer Coil Component

An exemplary method for manufacturing a multilayer coil component according to the present disclosure will be described below.

First, ceramic green sheets that will eventually become individual insulating layers are fabricated. For example, an organic binder such as polyvinyl butyral-based resin, an organic solvent such as ethanol or toluene, and a dispersant are added to a ferrite material, followed by kneading to form a slurry. Then, by using a method such as doctor-blade, each ceramic green sheet with a thickness of about 12 μm is fabricated.

Examples of ferrite materials include those fabricated by a method described below. First, iron, nickel, zinc, and copper oxide raw materials are mixed together and calcined at about 800° C. for about one hour. The resulting calcined product is ground in a ball mill and dried, thus yielding a Ni—Zn—Cu-based ferrite material (oxide powder mixture) with a mean grain diameter of about 2 μm.

In fabricating each ceramic green sheet by use of a ferrite material, the ferrite material used preferably has the following composition from the viewpoint of obtaining a high inductance: $Fe_2O_3$ at not less than about 40 mol % and not more than about 49.5 mol % (i.e., from about 40 mol % to about 49.5 mol %); ZnO at not less than about 5 mol % and not more than about 35 mol % (i.e., from about 5 mol % to about 35 mol %); CuO at not less than about 4 mol % and not more than about 12 mol % (i.e., from about 4 mol % to about 12 mol %); and the remainder including NiO and trace amounts of additives (including incidental impurities).

Exemplary materials of a ceramic green sheet may include, besides magnetic materials such as the ferrite material mentioned above, non-magnetic materials such as glass-ceramic materials, and mixtures of magnetic and non-magnetic materials.

Subsequently, a conductor pattern that will eventually become each of a coil conductor and a via conductor is formed on each ceramic green sheet. For example, first, laser beam machining is applied to the ceramic green sheet to form a via hole with a diameter of not less than about 20 μm and not more than about 30 μm (i.e., from about 20 μm to about 30 μm). The via hole is then filled with a conductive paste such as a silver paste to form a via-conductor pattern, which is a conductor pattern that will become a via conductor. Further, a coil-conductor pattern, which is a conductor pattern that will become a coil conductor, is printed at a thickness of about 11 μm on the major surface of the ceramic green sheet by screen printing or other methods with a conductive paste such as a silver paste. An example of such a coil-conductor pattern printed is a conductor pattern corresponding to each coil conductor as illustrated in FIGS. 8 and 9, or a conductor pattern corresponding to each coil conductor as illustrated in FIGS. 10 and 11.

The resulting ceramic green sheet is then dried, thus obtaining a coil sheet with the coil-conductor pattern and the via-conductor pattern formed on the ceramic green sheet. The coil-conductor pattern and the via-conductor pattern on the coil sheet are connected with each other.

Separately from such coil sheets, via sheets with a via-conductor pattern formed on the ceramic green sheet are fabricated. The via-conductor pattern on each via sheet is a conductor pattern that will eventually become each via conductor constituting a connecting conductor.

Subsequently, coil sheets are stacked in a predetermined order such that a coil with a coil axis parallel to the mounting surface will be formed inside the multilayer body after separation into discrete chips and firing. Further, via sheets are stacked on the top and bottom of the stack of coil sheets.

Subsequently, the stack of coil sheets and the stack of via sheets are subjected to pressure bonding under heat to obtain a pressure-bonded body, which is then cut into smaller portions with dimensions corresponding to a predetermined chip size to thereby obtain discrete chips. The discrete chips are subjected to, for example, barrel finishing to have rounded corners and rounded edges.

Subsequently, each discrete chip is subjected to de-binding and firing at a predetermined temperature for a predetermined period of time to thereby form a multilayer body (fired body) with a coil incorporated therein. After the firing process, the coil-conductor pattern and the via-conductor pattern respectively become a coil conductor and a via conductor. The coil is made up of coil conductors connected by via conductors. The stacking direction of the multilayer body, and the direction of the coil axis of the coil are parallel to the mounting surface.

Subsequently, the multilayer body is immersed obliquely in a layer of a conductive paste such as a silver paste drawn into a predetermined thickness, following by baking to form an underlying electrode layer for the outer electrode on four faces (the major surface, the end surface, and both lateral surfaces) of the multilayer body. As opposed to a method of forming an underlying electrode layer on each of the major surface and the end surface of the multilayer body in two separate steps, the above-mentioned method makes it possible to form the underlying electrode layer at once in a single step.

Subsequently, a nickel coating and a tin coating are sequentially formed at a predetermined thickness on the underlying electrode layer by plating. As a result, an outer electrode is formed.

In forming an outer electrode, for example, the underlying electrode layer, the nickel coating, and the tin coating are sequentially formed with a mask applied at a predetermined position on each lateral surface of the multilayer body, such that the resulting outer electrode has a substantially concave shape as illustrated in FIGS. 4 and 5 as viewed in plan in the width direction.

Through the above-mentioned process, the multilayer coil component according to the present disclosure is manufactured.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body formed by stacking a plurality of insulating layers in a length direction, the multilayer body including a coil built in the multilayer body; and a first outer electrode and a second outer electrode that are electrically connected to the coil, wherein the coil is formed by electrically connecting a plurality of coil conductors, the coil conductors being stacked in the length direction together with the insulating layers, wherein the multilayer body has a first end surface and a second end surface that face each other in the length direction, a first major surface and a second major surface that face each other in a height direction orthogonal to the length direction, and a first lateral surface and a second lateral surface that face each other in a width direction orthogonal to the length direction and to the height direction, wherein the first major surface is a mounting surface, wherein a stacking direction of the multilayer body, and a direction of a coil axis of the coil are parallel to the first major surface, wherein the first outer electrode has a first electrode portion that covers a portion of the first end surface, a second electrode portion that extends from the first electrode portion to cover a portion of the first major surface, and a third electrode portion that extends from the first electrode portion and the second electrode portion to cover a portion of the first lateral surface, and wherein as viewed in plan in the width direction, the third electrode portion is substantially concave toward a vertex where a first edge and a second edge meet, the first edge being an edge where the first electrode portion and the third electrode portion meet, and the second edge being an edge where the second electrode portion and the third electrode portion meet, each coil conductor has a line portion, and a land portion disposed in an end portion of the line portion, the land portions of the coil conductors that are adjacent to each other in the stacking direction are connected with each other by a via conductor, and as viewed in plan in the width direction, the land portion is located in an upper half region of the multilayer body located opposite to the first major surface.

2. The multilayer coil component according to claim 1, wherein as viewed in plan in the width direction, the third electrode portion has an area of from about 20% to about 80% of an area of a triangle, the triangle being a triangle formed by connecting the vertex, a first endpoint, and a second endpoint in the third electrode portion with each other by straight lines, the first endpoint being an endpoint lying on the first edge and different from the vertex, and the second endpoint being an endpoint lying on the second edge and different from the vertex.

3. The multilayer coil component according to claim 1, wherein a region where the coil conductors are disposed has a dimension in the stacking direction of from about 85% to about 95% of a length dimension of the multilayer body.

4. The multilayer coil component according to claim 1, wherein as viewed in plan in the width direction, the third electrode portion has a dimension on the second edge of from about 40 μm to about 145 μm.

5. The multilayer coil component according to claim 1, wherein a number of the stacked coil conductors is greater than or equal to 50, and as viewed in plan in the width direction, a number of the stacked coil conductors overlapping the third electrode portion is less than or equal to 10.

6. The multilayer coil component according to claim 1, wherein a number of the stacked coil conductors that define one turn of the coil is two.

7. The multilayer coil component according to claim 1, wherein the second outer electrode has a fourth electrode portion that covers a portion of the second end surface, a fifth electrode portion that extends from the fourth electrode portion to cover a portion of the first major surface, and a sixth electrode portion that extends from the fourth electrode portion and the fifth electrode portion to cover a portion of the first lateral surface.

8. The multilayer coil component according to claim 2, wherein a region where the coil conductors are disposed has a dimension in the stacking direction of from about 85% to about 95% of a length dimension of the multilayer body.

9. The multilayer coil component according to claim 2, wherein as viewed in plan in the width direction, the third electrode portion has a dimension on the second edge of from about 40 μm to about 145 μm.

10. The multilayer coil component according to claim 3, wherein as viewed in plan in the width direction, the third electrode portion has a dimension on the second edge of from about 40 μm to about 145 μm.

11. The multilayer coil component according to claim 2, wherein a number of the stacked coil conductors is greater than or equal to 50, and as viewed in plan in the width direction, a number of the stacked coil conductors overlapping the third electrode portion is less than or equal to 10.

12. The multilayer coil component according to claim 3, wherein a number of the stacked coil conductors is greater than or equal to 50, and as viewed in plan in the width direction, a number of the stacked coil conductors overlapping the third electrode portion is less than or equal to 10.

13. The multilayer coil component according to claim 4, wherein a number of the stacked coil conductors is greater than or equal to 50, and as viewed in plan in the width direction, a number of the stacked coil conductors overlapping the third electrode portion is less than or equal to 10.

14. The multilayer coil component according to claim 2, wherein a number of the stacked coil conductors that define one turn of the coil is two.

15. The multilayer coil component according to claim 3, wherein a number of the stacked coil conductors that define one turn of the coil is two.

16. The multilayer coil component according to claim 4, wherein a number of the stacked coil conductors that define one turn of the coil is two.

17. The multilayer coil component according to claim 5, wherein a number of the stacked coil conductors that define one turn of the coil is two.

18. The multilayer coil component according to claim 2, wherein the second outer electrode has a fourth electrode portion that covers a portion of the second end surface, a fifth electrode portion that extends from the fourth electrode portion to cover a portion of the first major surface, and a sixth electrode portion that extends from the fourth electrode portion and the fifth electrode portion to cover a portion of the first lateral surface.

19. The multilayer coil component according to claim 3, wherein the second outer electrode has a fourth electrode portion that covers a portion of the second end surface, a fifth electrode portion that extends from the fourth electrode portion to cover a portion of the first major surface, and a sixth electrode portion that extends from the fourth electrode portion and the fifth electrode portion to cover a portion of the first lateral surface.

20. The multilayer coil component according to claim 4, wherein the second outer electrode has a fourth electrode portion that covers a portion of the second end surface, a fifth electrode portion that extends from the fourth electrode portion to cover a portion of the first major surface, and a sixth electrode portion that extends from the fourth electrode portion and the fifth electrode portion to cover a portion of the first lateral surface.

* * * * *